US006345514B1

(12) United States Patent
Moon et al.

(10) Patent No.: US 6,345,514 B1
(45) Date of Patent: Feb. 12, 2002

(54) DEVICE FOR DISPOSING OF CONDENSATE FROM SMALL SIZED AIR CONDITIONER

(75) Inventors: Dong Soo Moon; Cheol Soo Ko, both of Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 09/770,448

(22) Filed: Jan. 29, 2001

(30) Foreign Application Priority Data

Sep. 8, 2000 (KR) ..... 00-53449
Sep. 8, 2000 (KR) ..... 00-53450

(51) Int. Cl.[7] ..... F25B 47/00
(52) U.S. Cl. ..... 62/279; 62/277; 62/281; 62/513
(58) Field of Search ..... 62/277, 279, 281, 62/513

(56) References Cited

U.S. PATENT DOCUMENTS 4,250,717 A * 2/1981 Stone ..... 62/279
4,497,183 A * 2/1985 Gelbard et al. ..... 62/295
4,876,861 A * 10/1989 Tanaka et al. ..... 62/279
5,271,241 A * 12/1993 Kim ..... 62/285
5,682,757 A * 11/1997 Peterson ..... 62/259.2
5,881,566 A * 3/1999 Shacklock et al. ..... 62/277
5,966,958 A * 10/1999 Maynard ..... 62/277
5,992,171 A * 11/1999 Bacchus ..... 62/305
6,065,299 A * 5/2000 Chen ..... 62/277

* cited by examiner

*Primary Examiner*—William Doerrler
*Assistant Examiner*—Mark S. Shulman

(57) ABSTRACT

Small sized air conditioner including a heat discharging part having a small sized compressor and condenser, a heat absorbing part having a small sized evaporator, a drain hose for transferring condensate from the evaporator to the heat discharging part, and a device for disposing of condensate fitted in the heat discharging part for vaporizing the condensate transferred through the drain hose by using a heat generated at the heat discharging part, thereby facilitating easy installation and movement.

9 Claims, 9 Drawing Sheets

DEVICE FOR DISPOSING OF CONDENSATE FROM SMALL SIZED AIR CONDITIONER

BACKGROUND OF THE INVENTION

1. Field of the Invention

The present invention relates to an air conditioner, and more particularly, to a device for disposing of condensate from a small sized air conditioner, which can remove condensate formed at an evaporator of the air conditioner without draining the condensate to outside of the air conditioner.

2. Background of the Related Art

The air conditioner maintains a temperature, a humidity, and the like of a desired space (air conditioned space) at appropriate states by using a refrigerating cycle of compression, condensation, expansion, and evaporation of a refrigerant. In the air conditioner, there are package type air conditioners and room air conditioners. In general, the air conditioner has a heat discharging part with the condenser and a heat absorbing part with the evaporator arranged in separate places. And, since the heat discharging part is arranged outside of the room, the heat discharging part is called as an outdoor unit, and, since the heat absorbing part is arranged inside the room, the heat absorbing part is called as an indoor unit. A related art room air conditioner will be explained with reference to FIG. 1.

A heat discharging part 5 is arranged outside of the room, and, the heat absorbing part 3 is arranged inside of the room. For an example, the heat absorbing part 3 is fixed to a wall, and the heat discharging part 5 is placed on a veranda or the like. There is refrigerant pipe lines connected between the heat absorbing part 3 and the heat discharging part 5 for flow of the refrigerant. And, there is a drain hose 9 connected to the heat absorbing part 3 for discharging the condensate formed at the evaporator of the heat absorbing part 3.

A system of the heat absorbing part will be explained, with reference to FIG. 2. The heat absorbing part 3 is provided with an evaporator 37 and a fan 38 fitted inside thereof. And, there is a suction grill 33 in front portion of a body 31 of the heat absorbing part, for drawing air from the room, and a discharge grill 35 below the body 31 of the heat absorbing part, for discharging cooled air heat exchanged with the evaporator 37 into the room again.

The operation of the related art air conditioner will be explained, with reference to FIGS. 1 and 2.

The room air flowed into the suction grill 33 is cooled down as the room air is heat exchanged at the evaporator 37, and discharged into the room again, for maintaining the room temperature at a preset level. The evaporated refrigerant is provided to a compressor in the heat discharging part 5 through a low pressure pipe line 7*b*, and compressed and provided to the condenser. The refrigerant makes heat exchange with external air at the condenser to condense the refrigerant and discharge heated air outside of the room. The condensed refrigerant is expanded at an expansion valve and flows to the evaporator 37 through a high pressure pipe line 7*a* again. By repeating the foregoing process, the room, i.e., the air conditioned space 1 can be maintained at a desired temperature.

In the meantime, water drops are formed on a surface of the evaporator 37 during heat exchange between the room air and the refrigerant at the evaporator 37 in the heat absorbing part 3, because a surface temperature of the evaporator 37 is very low compared to the room temperature, to cool down the room air in contact with the evaporator 37 below a dew point of the air. The water drops formed at the evaporator 37 are collected at a place along a drain channel 39 in the heat absorbing part 3 and drained to outside of the room through a drain hose 9.

However, the related art air conditioner is in general not convenient to install owing to its heavy weight. And, the air conditioner once installed is difficult to disassemble, since the refrigerant pipe lines are passed through a wall and fastened at desired locations, and moving the air conditioner once installed to other place is difficult. And, in general the drain hose for draining the condensate formed at the evaporator is passed through the wall and exposed to outside of the room, of which outer appearance, not only is poor, but also limits the installation location, and since moving the drain hose once placed at a desired location is difficult, moving the air conditioner actually becomes impossible. Therefore, in order to develop a local space cooling air conditioner, or a small sized air conditioner, which is convenient and simple in installation and movement, enough to permit an instant cooling of, not the entire air conditioning space, but a particular space, solving the problem has been a prerequisite.

SUMMARY OF THE INVENTION

Accordingly, the present invention is directed to a device for disposing of condensate from a small sized air conditioner that substantially obviates one or more of the problems due to limitations and disadvantages of the related art.

An object of the present invention is to provide a device for disposing of condensate from a small sized air conditioner without draining the condensate so that the air conditioner can be moved and installed with easy.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, the small sized air conditioner includes a heat discharging part having a small sized compressor and condenser, a heat absorbing part having a small sized evaporator, a drain hose for transferring condensate from the evaporator to the heat discharging part, and a device for disposing of condensate fitted in the heat discharging part for vaporizing the condensate transferred through the drain hose by using a heat generated at the heat discharging part.

The device for disposing of condensate includes a cylindrical body around an outer circumference of the compressor, and a plurality of flow paths in the cylindrical body for guiding the condensate.

The device for disposing of condensate includes a cylindrical body around an outer circumference of the compressor, and a condensate absorbing member fitted in the cylindrical body.

The device for disposing of condensate includes a condensate distributor fitted over the condenser for distributing the condensate transferred through the drain hose onto the condenser. The condenser has slit fin type cooling fins, and more than 19 of the cooling fins are arranged per one inch.

Since exposure of the drain hose to outside of the room is not required, the present invention permits easy installation and movement of the air conditioner.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENT

Figure 1:
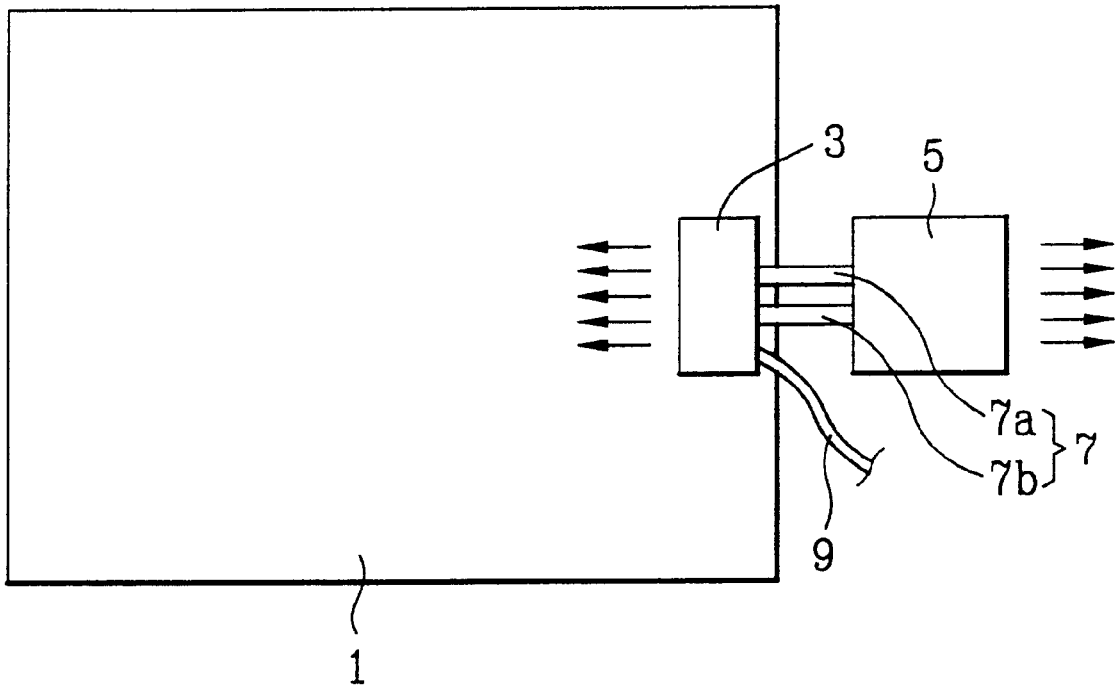
FIG. 1 Related Art
FIG. 1 illustrates installation of a related art air conditioner, schematically.
Figure 2:
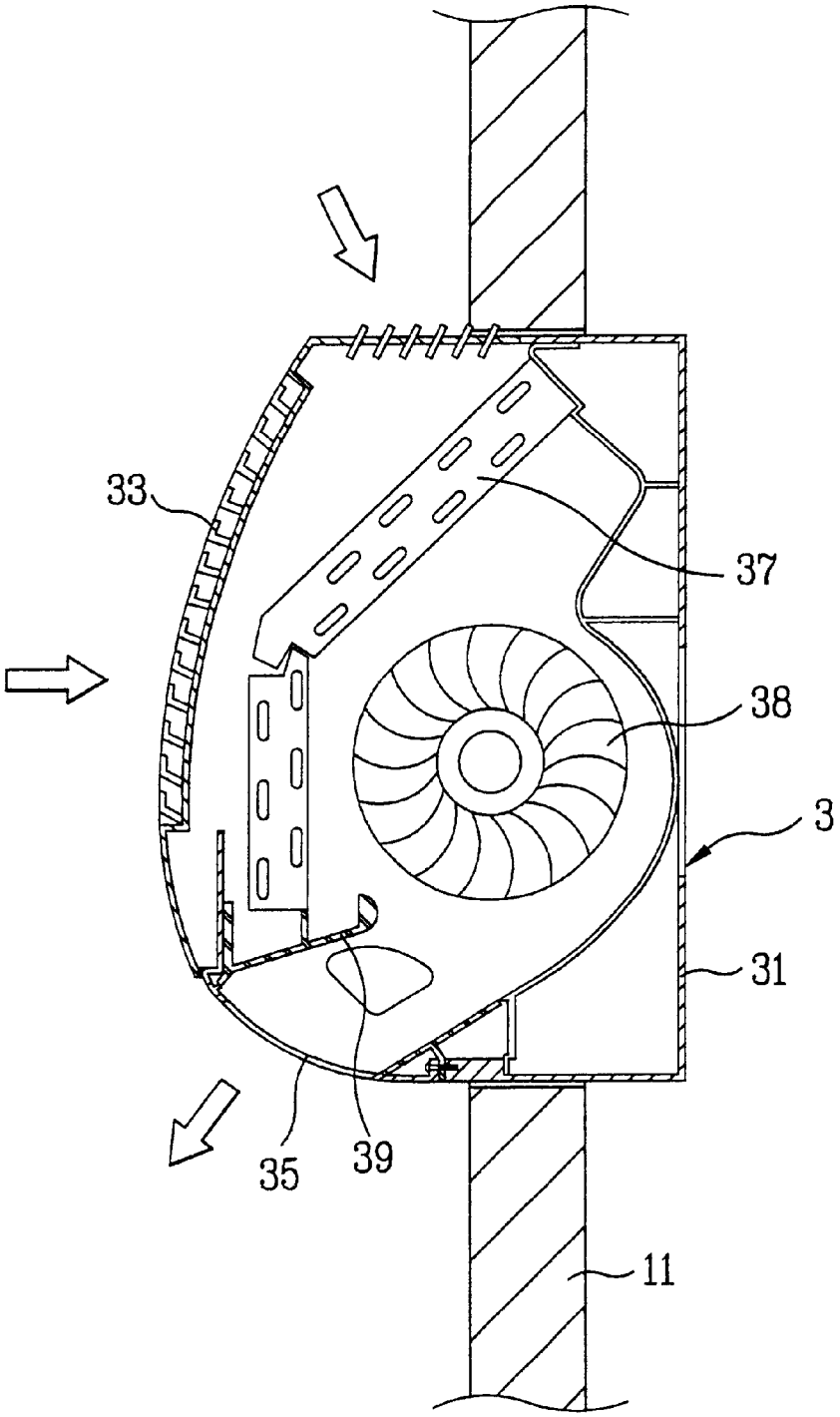
FIG. 2 Related Art
FIG. 2 illustrates a section of a heat absorbing part(indoor unit) of a related art air conditioner installed in a wall.
Figure 3:
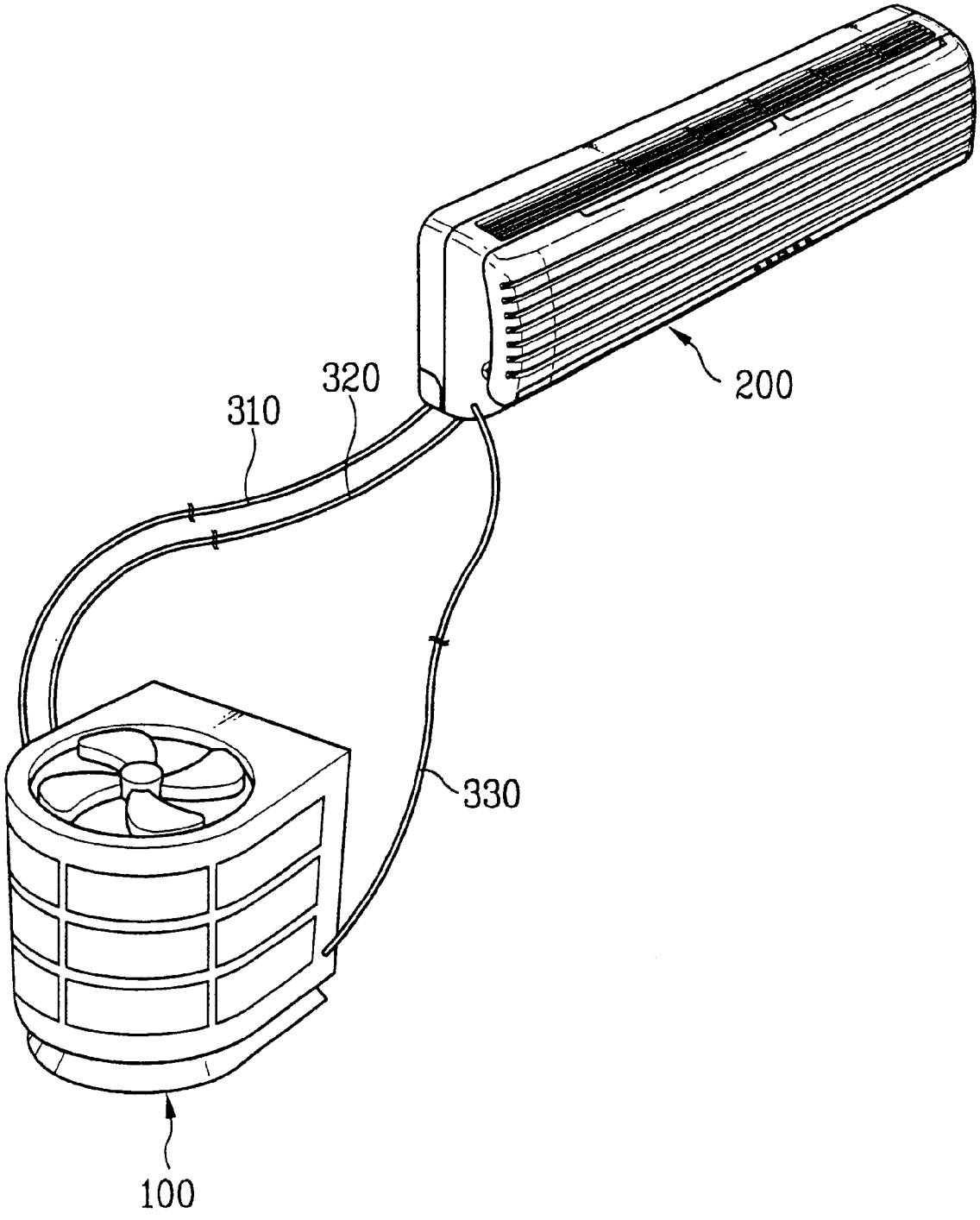
FIG. 3 illustrates a perspective view of a small sized air conditioner in accordance with a preferred embodiment of the present invention.

Reference will now be made in detail to the preferred embodiments of the present invention, examples of which are illustrated in the accompanying drawings. A small sized air conditioner in accordance with a preferred embodiment of the present invention will be explained with reference to FIG. 3. Alike the related art air conditioner, the air conditioner of the present invention also includes a compressor, a condenser, an expansion valve, an evaporator and the like, for employing the refrigerating cycle. Of course, the condenser is in the heat discharging part 100, and the evaporator is in the heat absorbing part 200. However, since a purpose of the air conditioner of the present invention lies on cooling a local space, an air conditioner with a small cooling capacity is acceptable, with consequential small sized heat absorbing part 200 and heat discharging part 100 required, that renders a convenience in moving and installation of the air conditioner. Moreover, it is preferable that the high pressure pipe line 310 and the low pressure pipe line 320 are formed of flexible material for improving the convenience in moving and installation of the air conditioner, and detachably connected between the heat absorbing part 200 and the heat discharging part 100 by means of quick coupling or the like, for easy installation and moving of the heat absorbing part 200 and the heat discharging part 100. For further improvement of the installation and moving of the air conditioner, one end of the drain hose 330 is connected to the heat absorbing part 200, and the other end is connected to the heat discharging part 100. The condensate transferred to the heat discharging part 100 is, not drained outside of the room, but removed by the device for removing the condensate from the heat discharging part 100. It is of course preferable that the drain hose 330 is also formed of a flexible material.

Figure 4:
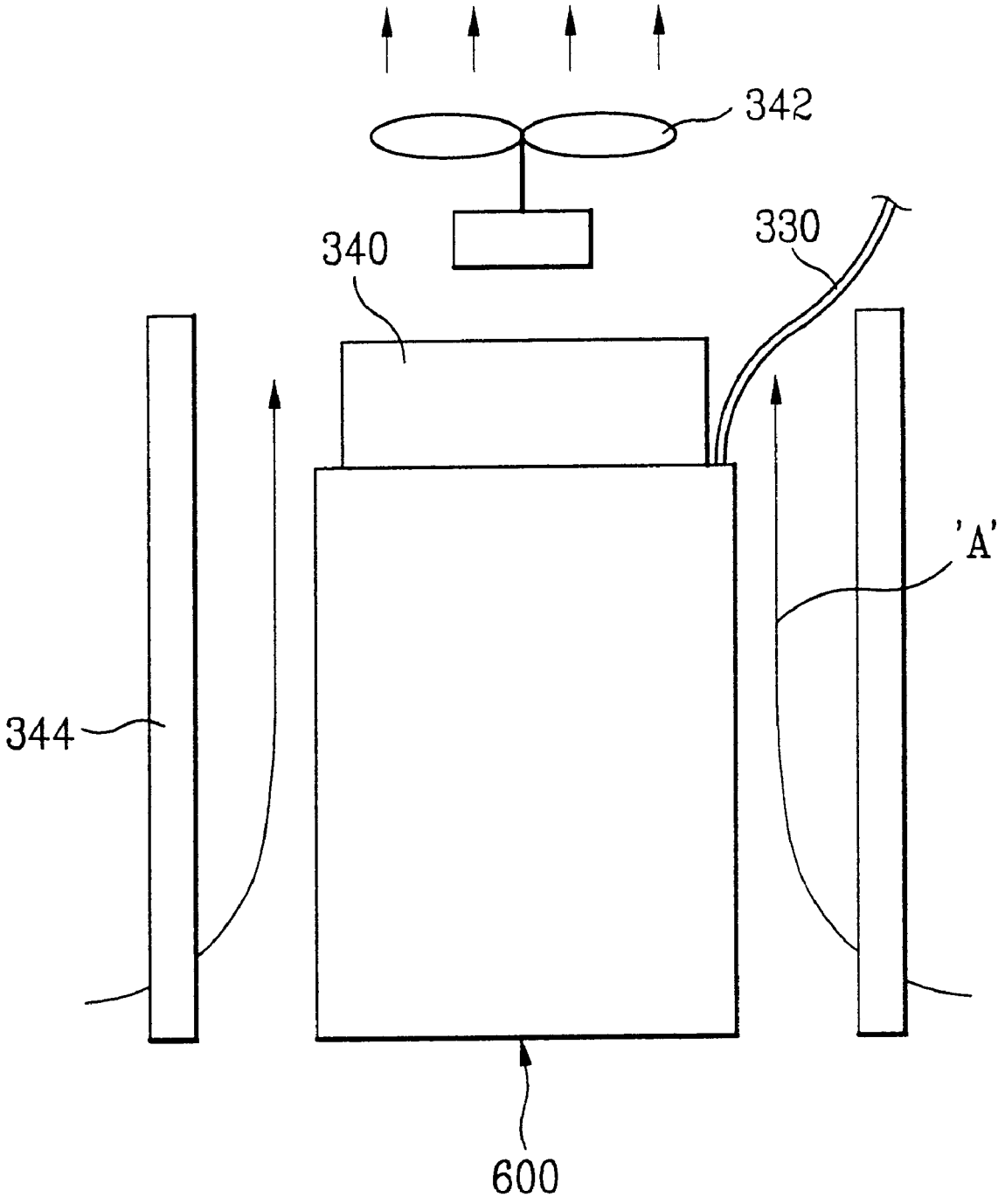
FIG. 4 illustrates a configuration of a device for disposing of condensate from a small sized air conditioner in accordance with a first preferred embodiment of the present invention, schematically.
Figure 5:
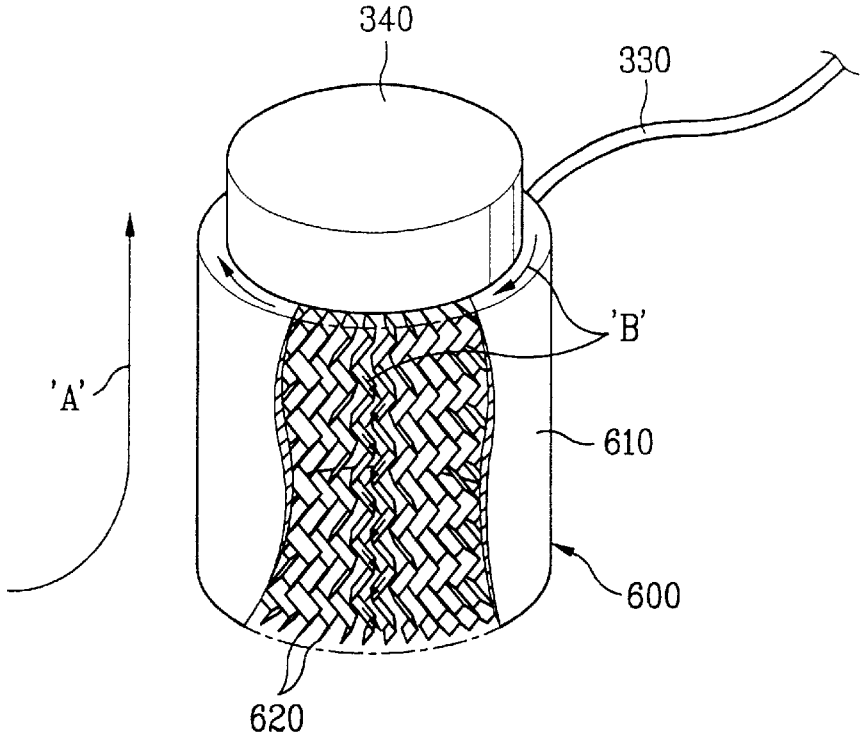
FIG. 5 illustrates a perspective view of the device for disposing of condensate in FIG. 4.

The device for disposing of condensate from a small sized air conditioner in accordance with a first preferred embodiment of the present invention will be explained, with reference to FIGS. 4 and 5.

There is a condenser 344 on outside of a compressor 340, and a device for disposing of condensate on an outside surface of the compressor 340. There is a fan 342 above the compressor 340 for drawing external air. The present invention suggests to vaporize the condensate formed at the evaporator and introduced into the device 600 for removing condensate fitted outside of the compressor 340 by using a heat from the compressor 340. This is made possible because the compressor 340 generate a significantly high temperature when the compressor 340 compresses the refrigerant from a low temperature and low pressure state to a high temperature and high pressure state. In the case of the small sized compressor, a surface temperature of the compressor 340 is in a range of 70–80° C.

The device for disposing of condensate will be explained in detail. The device for disposing of condensate 600 includes a cylindrical body 610 around an outer circumference of the compressor 340, and a plurality of flow paths 620 in the cylindrical body 610 for guiding the condensate. One end of the drain hose 330 is connected to a top of the cylindrical body 610 of the device 600. Therefore, the condensate introduced into the device 600 through the drain hose 330 is vaporized as the condensate flows along a flow path 620 in the body 610 of the device 600 by the heat of the compressor 340. It is preferable that the body 610 and the flow path 620 of the device 600 are formed of a metal with a high thermal conductivity and an inside surface of the flow path 620 is coated with hydrophilic material for flowing of the condensate, with the condensate evenly distributed on the inside surface, but not in drops. In the meantime, it is preferable that the fan 342 is mounted above the compressor 340, for accelerating evaporation of the condensate as a flow direction 'B' of the condensate is opposite to a flow direction of external air introduced thereto by the fan. And, it is preferable that the body 610 of the device 600 is detachably fitted to the compressor 340, for throwing out a small amount of not vaporized water, later. Thus, the foregoing device for disposing of condensate can evaporate all the condensate, without draining the condensate.

Figure 6:
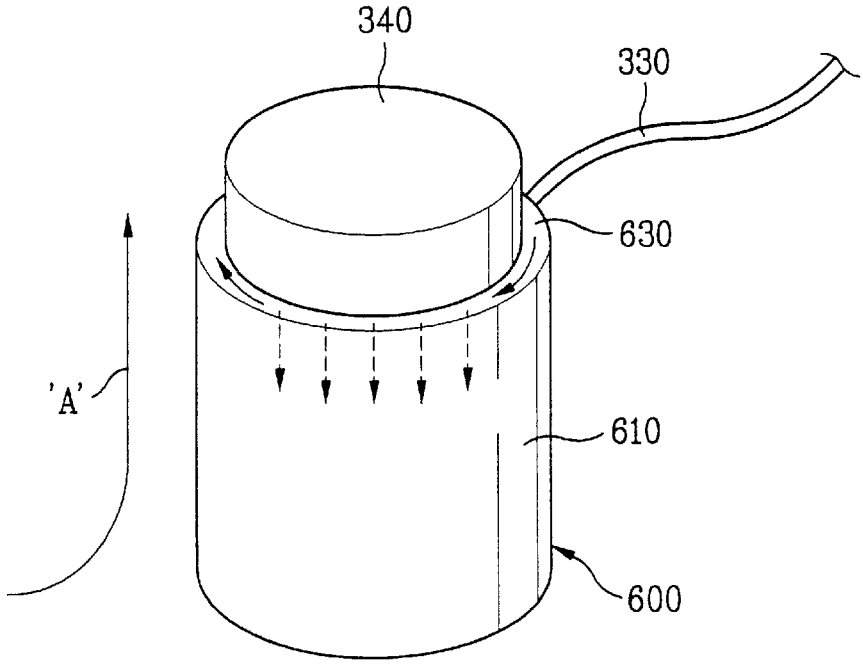
FIG. 6 illustrates a configuration of a device for disposing of condensate from a small sized air conditioner in accordance with a second preferred embodiment of the present invention, schematically.

A device for disposing of condensate from a small sized air conditioner in accordance with a second preferred embodiment of the present invention will be explained, with reference to FIG. 6. Though the second embodiment device is similar to the first embodiment, the second embodiment device forms no flow path, but provides a condensate absorbing member 630 which can absorb water(condensate) well. The operation of the second embodiment device will be omitted as the operation of the second embodiment device is the same with the first embodiment device.

Figure 7:
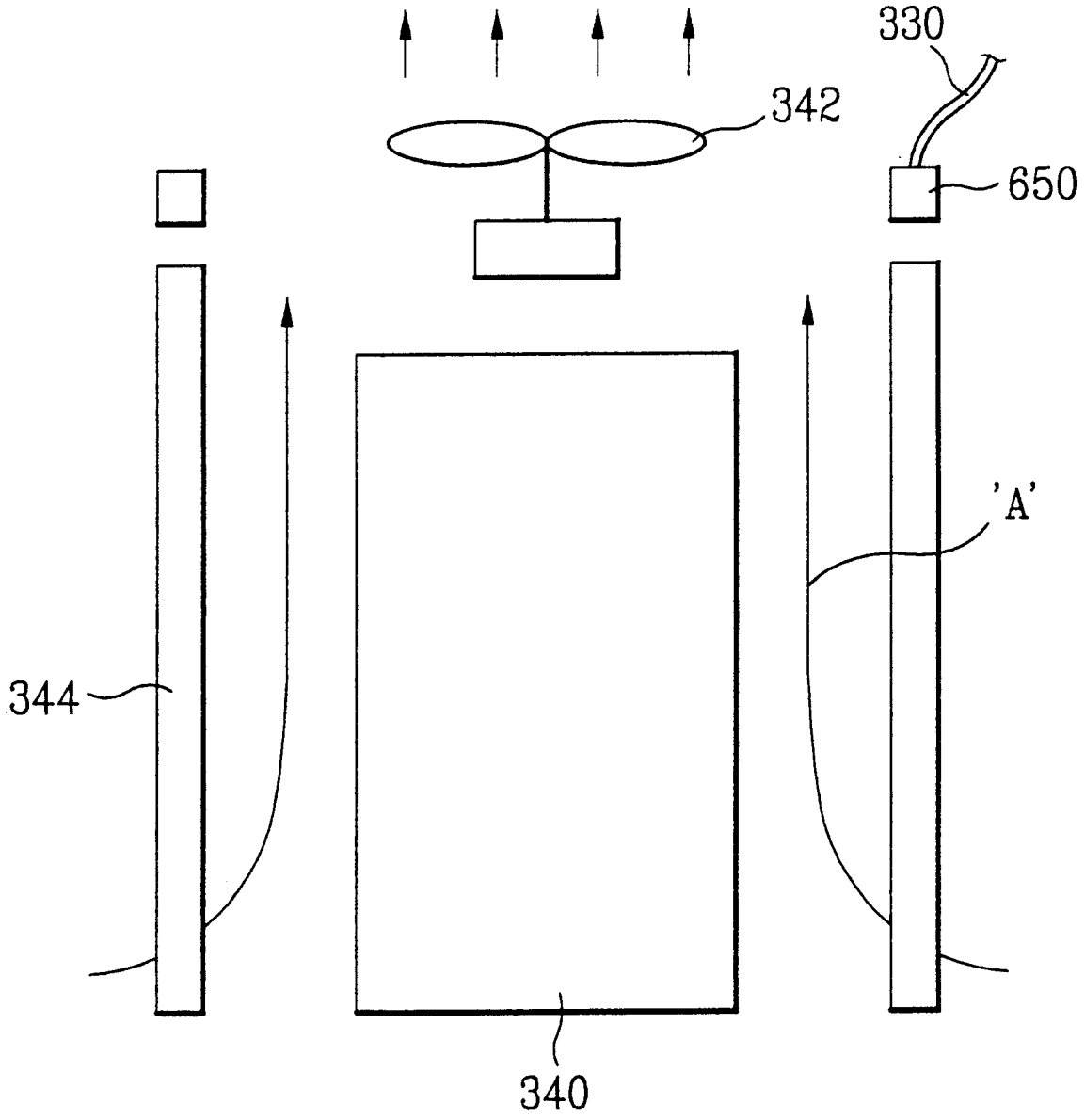
FIG. 7 illustrates a configuration of a device for disposing of condensate from a small sized air conditioner in accordance with a third preferred embodiment of the present invention, schematically.
Figure 8:
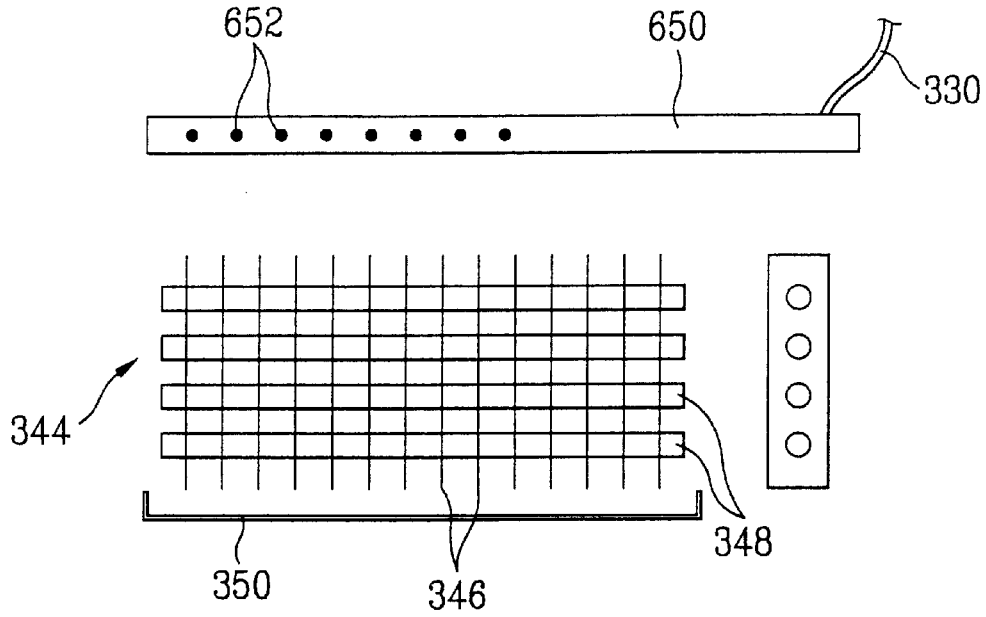
FIG. 8 illustrates the device for disposing of condensate in FIG. 7 in detail.

A device for disposing of condensate from a small sized air conditioner in accordance with a third preferred embodiment of the present invention will be explained, with reference to FIGS. 7 and 8. Alike the first or the second embodiment device, the third embodiment device also evaporates condensate at the heat discharging part. However, the first or the second embodiment device uses the heat from the compressor in evaporation of the condensate, the third embodiment device uses the heat generated when the refrigerant is condensed at the condenser in evaporation of the condensate. The third embodiment device will be explained in detail. There is a condenser 344 on outside of a compressor 340, and a condensate distributer 650 over the condenser 344 for spraying the condensate from the evaporator onto the condenser 344, evenly. Of course, there is a drain hose 330 connected to one end of the condensate distributer 650. There is a fan 342 over the compressor 340 for introducing external air. This will be explained in detail. The condenser 344 has a plurality of refrigerant tubes 348 for refrigerant flow, and a plurality of cooling fins 346 fitted substantially perpendicular to the refrigerant tubes 348. And, there is the condensate distributer 650 over the condenser 344 for even distribution of condensate onto the condenser 344. And, it is preferable that the condensate distributer 650 has a plurality of distribution holes 652 corresponding to the cooling fins 346. And, it is preferable that there is a condensate reserving means 350 under the condenser 344 for receiving a small amount of condensate not yet vaporized as the condensate flows along the cooling fins 346, and throwing out the small amount of condensate.

The operation of the device for disposing of condensate of the present invention will be explained. The condensate from the evaporator is introduced into the condensate distributer 650 through the drain hose 330. Then, the condensate is discharged toward the condenser 344 in drop of water through the distribution holes 652 as the condensate flows along the condensate distributer 650. The condensate discharged from the distribution holes 652 flows on the cooling fins 346. The condensate flowing on the cooling fins 346 is vaporized by a heat discharged from the condenser 344. Accordingly, all the condensate is vaporized by the time the condensate reaches to a lower portion of the cooling fins 346. By the way, identical to the foregoing embodiments, it is preferable that the fan 342 is mounted over the compressor, because opposite direction flows of the condensate 'C' and external air 'A' by the fan accelerate vaporization of the condensate. Thus, the device for disposing of condensate of the present invention can vaporize all the condensate without draining outside of the air conditioner.

Figure 9:
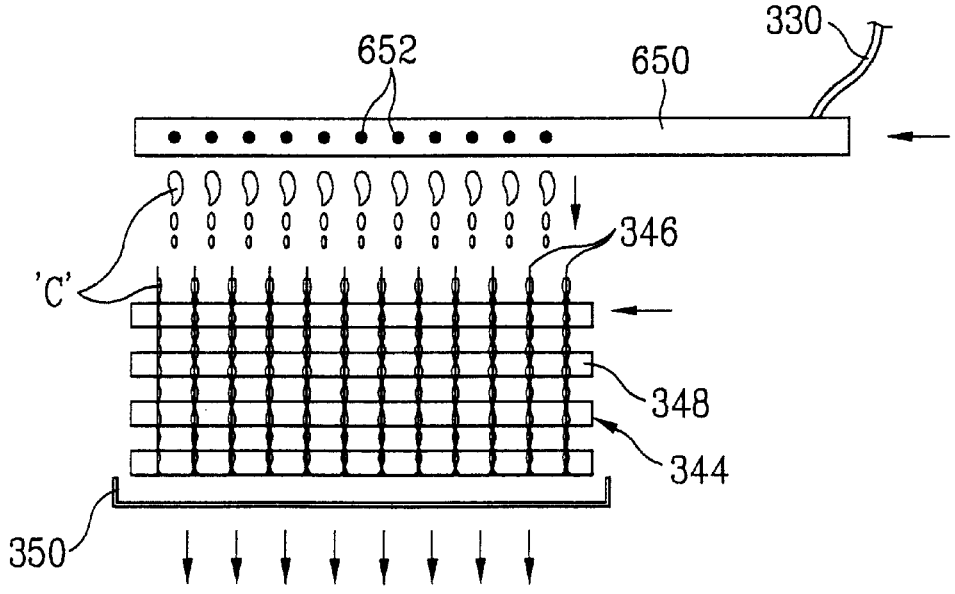
FIG. 9 illustrates the operation of the device for disposing of condensate in FIG. 8, schematically.
Figure 10:
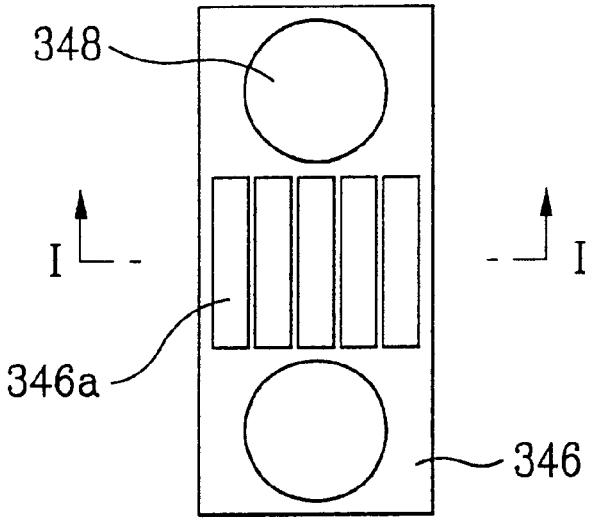
FIG. 10 illustrates an enlarged side view of the cooling fin in FIG. 7.
Figure 11:
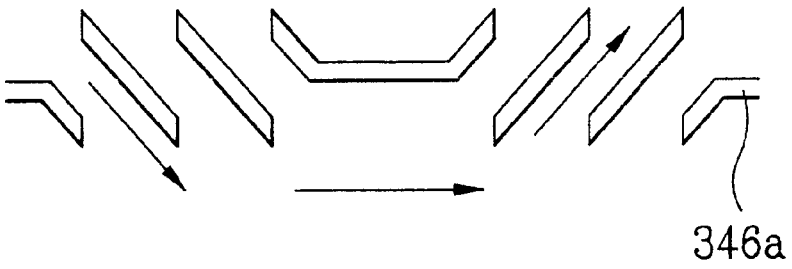
FIG. 11 illustrates a section across line I—I in FIG. 10.
Figure 12:
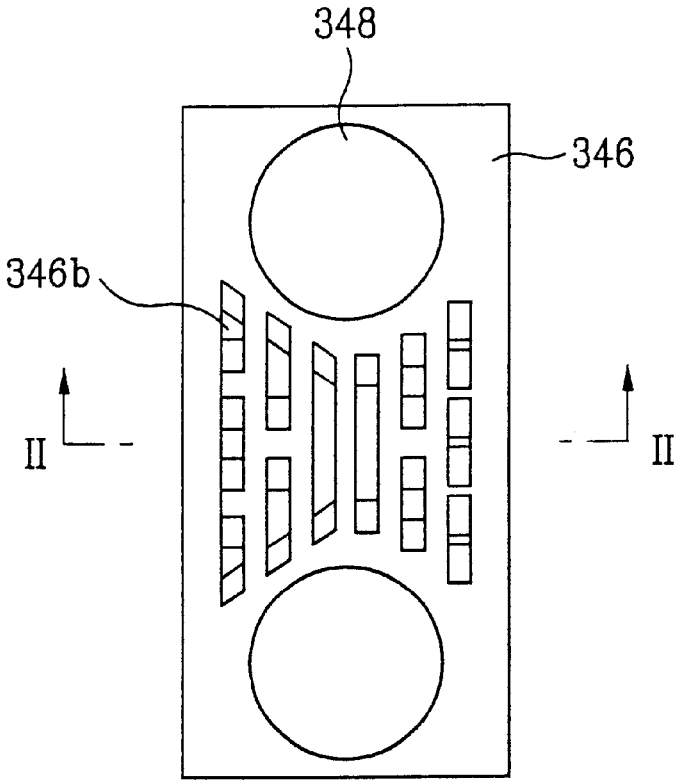
FIG. 12 illustrates a side view of an example of cooling fins used in the device for disposing of condensate in FIG. 7; and, FIG. 13 illustrates a section across line II—II in FIG. 12.
Figure 13:
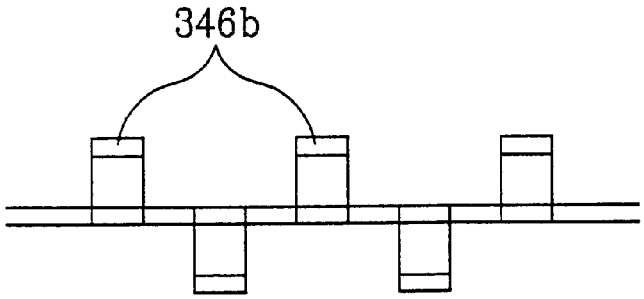

In the meantime, louvered type fins as the cooling fins 346, i.e., cooling fins with a plurality of louvers 346*a*, may fail to vaporize all the condensate because the louvered type fins have a poor adhesion characteristics for the condensate to allow the condensate to flow down comparatively, quickly. Therefore, as shown in FIGS. 9 and 10, it is preferable that slit fin type cooling fins 346 are used, for accelerating vaporization of the condensate as the condensate stays in the slits 346*b* for a long time period. And, smaller gaps between the cooling fins 346, which leads separation of the condensate into small portions, improves dispersion of the condensate, so that all the small portions can be vaporized as the small portions flow down between the cooling fins 346. More than 19 cooling fins per 1" is preferable.

The device for disposing of condensate of the present invention is applicable to all air conditioners of which condensate is comparatively small.

As has been explained, the device for disposing of condensate from a small sized air conditioner of the present invention has the following advantages.

First, the device for disposing of condensate from a small sized air conditioner of the present invention can vaporize within the air conditioner itself without draining outside of the room. That is, since no exposure of the drain hose outside of the room is required, with no requirement for making a hole in a wall, installation of the air conditioner is simple and has good outer look.

Second, since the air conditioner can be moved or installed without limitation of locations, not an entire space, but a particular space, can be cooled. intensively.

Third, a performance of the air conditioner can be improved as a surface temperature of the compressor can be lowered.

It will be apparent to those skilled in the art that various modifications and variations can be made in the device for disposing of condensate from a small sized air conditioner of the present invention without departing from the spirit or scope of the invention. Thus, it is intended that the present invention cover the modifications and variations of this invention provided they come within the scope of the appended claims and their equivalents.

What is claimed is:

1. A small sized air conditioner comprising:

a heat discharging part having a small sized compressor and condenser;

a heat absorbing part having a small sized evaporator;

a drain hose for transferring condensate from the evaporator to the heat discharging part;

a device for disposing of condensate fitted in the heat discharging part for vaporizing the condensate transferred through the drain hose by using a heat generated at the heat discharging part; and a fan over the compressor for introducing external air in a direction opposite to a flow direction of the condensate.

2. A small sized air conditioner as claimed in claim 1, wherein the device for disposing of condensate includes;

a cylindrical body around an outer circumference of the compressor, and a plurality of flow paths in the cylindrical body for guiding the condensate.

3. A small sized air conditioner as claimed in claim 2, wherein the flow path includes a coat of hydrophilic material applied thereon.

4. A small sized air conditioner as claimed in claim 1, wherein the device for disposing of condensate includes;

a cylindrical body around an outer circumference of the compressor, and a condensate absorbing member fitted in the cylindrical body.

5. A small sized air conditioner as claimed in claim 1, wherein the device for disposing of condensate is detachably fitted.

6. A small sized air conditioner as claimed in claim 1, wherein the device for disposing of condensate includes a condensate distributor fitted over the condenser for distributing the condensate transferred through the drain hose onto the condenser.

7. A small sized air conditioner as claimed in claim 6, wherein the condenser has slit fin type cooling fins.

8. A small sized air conditioner as claimed in claim 7, wherein more than 19 of the cooling fins are arranged per one inch.

9. A small sized air conditioner comprising:

a heat discharging part having a small sized compressor and condenser;

a heat absorbing part having a small sized evaporator;

a drain hose for transferring condensate from the evaporator to the heat discharging part; and a device for disposing of condensate fitted in the heat discharging part for vaporizing the condensate transferred through the drain hose by using a heat generated at the heat discharging part, including, a condensate distributor fitted over the condenser for distributing the condensate transferred through the drain hose onto the condenser; and a condensate reserving means under the condenser for reserving condensate.

* * * * *